US010231057B2

(12) United States Patent
Sato et al.

(10) Patent No.: US 10,231,057 B2
(45) Date of Patent: Mar. 12, 2019

(54) UNIVERSAL SPEAKER

(71) Applicant: Sound Fun! Co., Ltd., Tokyo (JP)

(72) Inventors: Kazunori Sato, Tokyo (JP); Nobuhiro Miyahara, Tokyo (JP); Kentaro Matsuoka, Tokyo (JP)

(73) Assignee: Sound Fun Corporation, Tokyo (JP)

( * ) Notice: Subject to any disclaimer, the term of this patent is extended or adjusted under 35 U.S.C. 154(b) by 163 days.

(21) Appl. No.: 15/128,663

(22) PCT Filed: Feb. 26, 2015

(86) PCT No.: PCT/JP2015/055499
§ 371 (c)(1),
(2) Date: Sep. 23, 2016

(87) PCT Pub. No.: WO2015/146446
PCT Pub. Date: Oct. 1, 2015

(65) Prior Publication Data

US 2018/0220236 A1 Aug. 2, 2018

(30) Foreign Application Priority Data

Mar. 26, 2014 (JP) ..... 2014-083167

(51) Int. Cl.
*H04R 7/18* (2006.01)
*H04R 7/04* (2006.01)
(Continued)

(52) U.S. Cl.
CPC ..... *H04R 7/18* (2013.01); *H04R 7/04* (2013.01); *H04R 9/06* (2013.01); *H04R 1/26* (2013.01); *H04R 7/12* (2013.01); *H04R 17/00* (2013.01)

(58) Field of Classification Search
CPC ..... H04R 7/04; H04R 7/045
(Continued)

(56) References Cited

U.S. PATENT DOCUMENTS 3,798,391 A 3/1974 Parker
5,570,429 A 10/1996 Paddock
(Continued)

FOREIGN PATENT DOCUMENTS

JP 50-013027 A 2/1975
JP 62-073898 A 4/1987
(Continued)

*Primary Examiner* — Maria El-Zoobi
(74) *Attorney, Agent, or Firm* — Dilworth & Barrese, LLP

(57) ABSTRACT

[Problem] To provide a universal speaker that efficiently transmits kinetic energy that has been converted from electrical energy of an audio signal to one or more diaphragms, and enables both healthy individuals and the hard of hearing to comfortably hear as a result of higher-volume and sharp emitted-sound. [Solution] This universal speaker (10) is provided at least with a diaphragm (1) having a planar shape, a driver unit (2) for causing the diaphragm to vibrate in accordance with an inputted electrical signal, and an enclosure (3) with a hollow structure for accommodating the diaphragm and the driver unit. The enclosure has an opening (39) at one surface, and the driver unit abuts against an end edge of the diaphragm so as to drive in the same direction as the plane direction of the diaphragm and is also fixedly mounted onto the enclosure. The diaphragm forms a curved section that curves going from one end (1*a*) side where the driver unit is mounted toward the opposing other end (1*b*) side, and is disposed so as to cover the opening of the enclosure.

20 Claims, 12 Drawing Sheets

(51) Int. Cl.

| | |
|---|---|
| ***H04R 9/06*** | (2006.01) |
| *H04R 7/12* | (2006.01) |
| *H04R 17/00* | (2006.01) |
| *H04R 1/26* | (2006.01) |

(58) Field of Classification Search
USPC ..... 381/395.01
See application file for complete search history.

(56) References Cited

U.S. PATENT DOCUMENTS

| | | | | |
|---|---|---|---|---|
| 5,652,801 | A | 7/1997 | Paddock | |
| 6,061,461 | A * | 5/2000 | Paddock | H04R 9/06 381/186 |
| 6,061,481 | A | 5/2000 | Paddock | |
| 2001/0026626 | A1 | 10/2001 | Athanas | |

FOREIGN PATENT DOCUMENTS

| | | | |
|---|---|---|---|
| JP | 62-278900 | A | 12/1987 |
| JP | 2003-259489 | A | 9/2003 |
| JP | 2004-356868 | A | 12/2004 |
| JP | 2006-332780 | A | 12/2006 |
| JP | 2007-019623 | A | 1/2007 |
| JP | 2009-194460 | A | 8/2009 |
| JP | 2009-278523 | A | 11/2009 |
| WO | 2013/050797 | A2 | 4/2013 |

* cited by examiner

UNIVERSAL SPEAKER

TECHNICAL FIELD

The present invention relates to a universal speaker, which enables both a hard-of-hearing individual and a hearing individual to catch a sound therefrom. More specifically, the present invention relates to a universal speaker, which enables a hard-of-hearing individual to catch a sound therefrom in company with a hearing individual without having to put a hearing aid on.

BACKGROUND ART

A "sound" is vibration of an object, which propagates through a substance such as air and can be sensed by an individual using hearing organs called the ears. That is to say, the sound is originated from a vibrating object. When the sound propagates by means of the air, a portion of the air is pressed as the object vibrates and this portion of the air becomes thicker accordingly. The thickened portion of the air further presses a nearby portion of the air. Thus, the thickened portion of the air keeps on migrating and eventually reaches the ears. Then, such portions of the air having reached the ears vibrate the eardrums in the ears. Signals of such vibration are transmitted to the brain, and the sound is heard at last as the brain determines the vibration as the sound.

In this way, the sound advances as a longitudinal wave which oscillates in a direction of gas molecules in the air being pulled and pressed back and forth, or in other words, which oscillates in the same direction as a direction of advance thereof. Meanwhile, when the sound propagates, portions in which the air is thin (sparse) and portions in which the air is thick (dense) are alternately transmitted as a wave. Accordingly, this longitudinal wave is also referred to as a "sparse-dense wave (or compression wave)".

Many speakers incorporated in general audio equipment are dynamic speaker units. Such a speaker unit at least includes: a donut-shaped magnet (a permanent magnet); a voice coil inserted into a cylindrical space that corresponds to a hole on an inner side of the magnet; and a diaphragm (a cone) formed into a conical shape and attached to the voice coil. In the above-described speaker, when a voice signal flows in the voice coil, the voice coil vibrates back and forth in accordance with a waveform of the voice signal, and the diaphragm attached to the voice coil vibrates together with the voice coil. Thus, the speaker generates a longitudinal wave having a waveform equal to that of the voice signal, and thus emits a sound.

Meanwhile, there has also been known a flat face speaker in which a flat plate-shaped diaphragm (a flat face diaphragm) is fixed in a vibratable manner to a rectangular frame. Such a flat face speaker generates a sparse-dense wave (a longitudinal wave) by pressing the air in a wide area in parallel byway of vibration of the flat face diaphragm, thereby emitting a sound (see Patent Document 1, for example).

In the meantime, the number of hearing-impaired individuals is increasing, including those with an aging-related hearing difficulty attributed to aging, an organic hearing difficulty with an impairment of any of the external ear, the middle ear, the internal ear, the cochlear nerves, and the like, a functional hearing difficulty attributed to stress, and so forth. The number of hard-of-hearing individuals in Japan is allegedly estimated to reach some 20 million. Such a hard-of-hearing individual may face not only with a risk of becoming hearing impaired but also with a difficulty in clearly distinguishing sounds which the individual manages to hear. Accordingly, the individual may fail to react to words of a companion, mislead the companion as a result of making an irrelevant response without an understanding of the contents of conversation, or spoil the conversation by frequently asking to repeat what the companion says in the middle of a talk. Such situations may hinder smooth communication. As a consequence, the hard-of-hearing individual is apt to hesitate talking with people without realizing, and thus to reduce opportunities of meeting people or to stay at home without going out. These phenomena are considered to create a problem of isolation and alienation from the society.

In general, hearing aids are used as a way to alleviate discomfort of the hearing impairment. On the other hand, in order to watch television, there is provided an FM transmitter to be connected to an earphone jack of a television, so as to transmit voices on FM radio waves and to allow an FM radio at hand to receive and acquire the voices on television.

Nevertheless, hearing aids are not preferred very much due to reasons such as being "troublesome" and "embarrassing to put them on" and are rather used reluctantly. Besides, there are quite a lot of hearing aids that pick up noise at the same time and rather end up in more stress.

On the other hand, the use of the FM transmitter is likely to require troublesome tasks of preparing the FM transmitter and installing the FM transmitter every time a user watches television. Moreover, an output destination of the sounds is switched as a result of connecting the FM transmitter to the earphone jack, which leads to a problem that a hard-of-hearing individual and a hearing individual cannot watch television together comfortably.

In the meantime, there is also a report that a sound is emitted not only as the sparse-dense wave (the longitudinal wave) but also as a transverse wave which oscillates in a direction orthogonal to the direction of advance. The transverse wave has features that attenuation of a sound in terms of a distance from a sound source is less than that of a longitudinal wave, and that it is audible to hard-of-hearing individuals. Moreover, regarding the transverse wave, there is another feature that two transverse waves or a transverse wave and a longitudinal wave do not interfere with each other.

In this regard, there has been proposed a speaker to emit a transverse wave audible to a hard-of-hearing individual, which includes a housing having a hollow structure, a drive unit housed in the housing, and a curved diaphragm formed by bending a flat plate and erected on a surface of the housing. Here, the speaker is configured to transmit vibration of the diaphragm of the drive unit to the curved diaphragm and the housing, and to emit a sound from the diaphragm of the drive unit, the curved diaphragm, and the housing (see Patent Document 2, for example).

However, the speaker described in Patent Document 2 uses the two diaphragms, namely, the diaphragm of the drive unit and the curved diaphragm erected on the face of the housing. Thus, the speaker is configured to generate a longitudinal wave audible to a hearing individual from the diaphragm of the drive unit, to generate a transverse wave audible to a hard-of-hearing individual from the curved diaphragm, and to emit sounds respectively therefrom. As a consequence, the speaker described in Patent Document 2 is not made capable of emitting a sound audible to both the hard-of-hearing individual and the hearing individual by using one diaphragm.

Meanwhile, an ideal way of radiating a large and clear sound is to transfer kinetic energy for driving the diaphragm of the driver transformed from electric energy entirely to the curved diaphragm side. However, there are various factors in the speaker of Patent Document 2 which are likely to reduce energy transfer efficiency when kinetic energy transformed from electric energy of a voice signal is transferred to the curved diaphragm side. Accordingly, the speaker of Patent Document 2 is thought to be unable to emit a larger and clearer sound because the speaker cannot efficiently transmit movement (the vibration) of the diaphragm of the drive unit to the curved diaphragm side.

Specifically, in the case of the speaker of Patent Document 2, an upright rod holds the curved diaphragm having the flat plate shape. Accordingly, the curved diaphragm is thought to be susceptible to an external force and the like, and is highly likely to deteriorate its energy transfer efficiency. Moreover, the drive unit is installed in a suspended state on an upper face of the housing. Accordingly, the drive unit is thought to be installed precariously and to be unable to sufficiently transfer the kinetic energy for driving the diaphragm of the driver to the curved diaphragm side. Furthermore, of the components constituting the drive unit, a frame is fixed to the diaphragm, and the frame is also fixed to a magnetic circuit attachment plate. Accordingly, this configuration is thought to restrict movement of the diaphragm of the drive unit generated by a magnetic circuit located on the magnetic circuit attachment plate, and to reduce (offset) the kinetic energy to be transferred to the curved diaphragm side by recoil of the diaphragm on the drive unit.

PRIOR ART DOCUMENTS

Patent Documents

Patent Document 1: Japanese Patent Application Publication No. Sho 62-278900

Patent Document 2: Japanese Patent No. 5393915

SUMMARY OF INVENTION

Technical Problem

The present invention has been made in view of the aforementioned circumstances. An object of the present invention is to provide a technique for transferring kinetic energy transformed from electric energy of a voice signal efficiently to one diaphragm, and to provide a universal speaker which emits a larger and clearer sound that can be caught comfortably by both a hard-of-hearing individual and a hearing individual.

Solution to Problem

A universal speaker according to a first aspect of the present invention, which enables both a hard-of-hearing individual and a hearing individual to catch a sound therefrom, includes at least: a diaphragm in a flat plate shape; a driver unit configured to vibrate the diaphragm in accordance with an inputted electric signal; and a housing having a hollow structure to house the diaphragm and the driver unit, in which the housing has an opening on one side, the driver unit is brought into contact with an edge portion of the diaphragm in such a way as to be driven in the same direction as a direction of a plane of the diaphragm, and is fixedly attached to the housing, and the diaphragm is formed into a curved surface portion being curved from one end side to which the driver unit is attached toward another end side opposite to the one end side, and disposed in such a way as to cover the opening of the housing.

A universal speaker according to a second aspect of the present invention is the universal speaker according to the first aspect, in which the driver unit includes a moving magnet actuator.

A universal speaker according to a third aspect of the present invention is the universal speaker according to the first aspect, in which the driver unit includes a moving coil actuator.

A universal speaker according to a fourth aspect of the present invention is the universal speaker according to any one of the first to third aspects, in which two side edge portions of the diaphragm are supported by the housing.

A universal speaker according to a fifth aspect of the present invention is the universal speaker according to any one of the first to fourth aspects, in which a plurality of the diaphragms are attached to the driver unit, and any of materials and bending angles of the diaphragms are different from each other.

A universal speaker according to a sixth aspect of the present invention is the universal speaker according to the fifth aspect, in which sizes of the diaphragms are different from each other.

A universal speaker according to a seventh aspect of the present invention is the universal speaker according to any one of the first to sixth aspects, in which a plurality of the driver units are attached to the one end side of the diaphragm.

A universal speaker according to an eighth aspect of the present invention is the universal speaker according to any one of the first to sixth aspects, in which the driver unit is additionally attached to the other end side of the diaphragm.

A universal speaker according to a ninth aspect of the present invention is the universal speaker according to the eighth aspect, in which one of the driver units includes an actuator utilizing a piezoelectric body.

A universal speaker according to a tenth aspect of the present invention is the universal speaker according to the eighth or ninth aspect which further includes means for splitting the electric signal into multiple frequency bands, in which electric signals thus split are inputted to the different driver units, respectively.

A universal speaker according to an eleventh aspect of the present invention is the universal speaker according to any one of the first to tenth aspects, in which a bending angle of the curved surface portion of the diaphragm is from 90° to 130°.

A universal speaker according to a twelfth aspect of the present invention is the universal speaker according to any one of the first to eleventh aspects, in which the diaphragm is part of the housing.

Advantageous Effects of Invention

In the universal speaker according to the present invention, the diaphragm having the flat plate shape is formed into the curved surface portion that is curved from the one end side toward the other end side opposed thereto, and the edge portion of the diaphragm is attached in contact to the driver unit in such a way as to be driven in the same direction as the direction of the plane thereof. As a consequence, it is possible to emit a large and clear sound.

Moreover, in the universal speaker according to the invention, a body portion of the driver unit is fixedly attached to the housing. Thus, installation of the drive unit in the housing is stabilized, so that the kinetic energy generated by the driving portion of the driver can be sufficiently transferred to the curved diaphragm side. Furthermore, the driving portion and the body portion of the drive unit are fixed to each other, and the driving portion of the drive unit is fixed to the housing, respectively. Thus, movement of the driving portion of the driving unit is not suppressed. In addition, there is no risk of reduction in (offset of) kinetic energy to be transferred to the curved diaphragm side by a counteraction of the driving portion of the drive unit. As a consequence, it is possible to transfer the kinetic energy transformed from the electric energy of the voice signal efficiently to one diaphragm, and thus to emit a larger and clearer sound.

Moreover, in the universal speaker according to the invention, the diaphragm is disposed such that the diaphragm covers the opening of the housing, which has the hollow structure provided with the opening on one side. Thus, the diaphragm is less likely to be affected by an external force and the like, and there is no risk of reduction in energy transfer efficiency. As a consequence, it is possible to further improve a sound emission performance.

Accordingly, it is possible to provide the universal speaker, which can transfer the kinetic energy transformed from the electric energy of the voice signal efficiently to one diaphragm and emit a larger and clearer sound, thereby enabling both a hard-of-hearing individual and a hearing individual to catch the sound comfortably. In addition, a risk of dementia is also thought to be reduced if an individual can retain the ability to hear sounds.

Furthermore, in the case where a hearing individual and a hard-of-hearing individual hear the same voice at the same time, the universal speaker according to the present invention allows the hard-of-hearing individual to hear the voice easily without letting the hearing individual feel noisy.

A definite mechanism (scheme) which explains a reason why both a hearing individual and a hard-of-hearing individual can hear the sound from the universal speaker according to the present invention is yet to be found. However, a possible reason is as follows.

First of all, a transverse wave, a bending wave, a torsional wave, and the like (hereinafter referred to as "shear waves") are considered to be generated in a solid aside from the longitudinal wave. Meanwhile, there is also the concept called wave-particle duality, which describes that every substance or energy exhibits both particle properties and wave properties. As a consequence, in the universal speaker according to the present invention, the vibration emitted from the curved surface portion of the curved diaphragm into the air is transformed into a sparse-dense wave of air molecules which is audible to the hearing individual on one hand, and also brings about new vibration (a shear wave) called perturbation of the air molecules which is audible to the hard-of-hearing individual.

DESCRIPTION OF EMBODIMENTS

Next, an embodiment of the present invention will be described.

Note that each of embodiments described below represents a preferred specific example of the present invention and therefore involves various technical restrictions. However, the scope of the present invention shall not be limited to the embodiments unless stated to be restricted as such in the following description.

Figure 1:
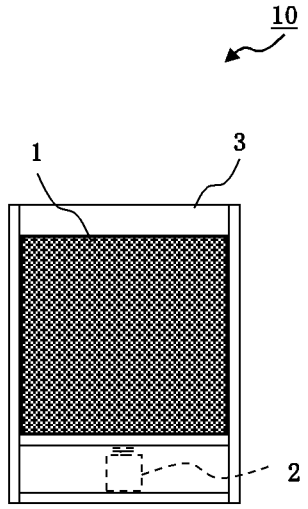
FIG. 1 is a front view showing a basic structure of a universal speaker according to the present invention.
Figure 2:
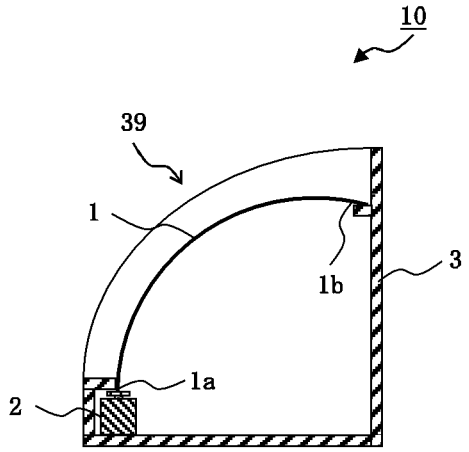
FIG. 2 is a vertical sectional view taken along a center line in a front view, which illustrates the universal speaker shown in FIG. 1.

As shown in FIG. 1 and FIG. 2, a universal speaker 10 of the present invention is configured to enable both a hard-of-hearing individual and a hearing individual to catch a sound therefrom, and at least includes a diaphragm 1, a driver unit 2, and a housing 3.

The diaphragm 1 has a flat plate shape. As shown in FIG. 2, the diaphragm 1 is formed into a curved surface portion that is curved from one end 1*a* side toward another end 1*b* side opposite thereto, in such a way as to cover an opening 39 of the housing 3. Specifically, the diaphragm 1 is a flat and thin member such as a film and a sheet, which is bent in advance to provide the curved surface portion, or alternatively, a member that has flexibility and a resilient property so as to be bent into the curved surface portion.

At least one end portion of the diaphragm 1 is attached to the driver unit 2.

When the diaphragm 1 is the member formed in advance to provide the curved surface portion, the diaphragm 1 is to be attached to the housing 3 such that its convex curved surface is directed forward. When the diaphragm 1 is the member having the flexibility, the diaphragm 1 is to be attached to the driver unit 2 in a state of being an upright flat plate, then formed into a curved surface by flexurally deforming the diaphragm 1 in this state, and attached to the housing 3 such that the convex curved surface side thus deformed is directed forward. The diaphragm 1 thus curved (hereinafter referred to as the "curved diaphragm") preferably has a bending angle of the curved surface portion equal to or slightly greater than 90°, or to be more precise, the bending angle in a range from 90° to 130°.

Specifically, while a shear wave is generated by the bend of the curved diaphragm 1, a generated sound pressure varies with the bending angle. To be more precise, the curved diaphragm 1 provided with the curved surface portion having the bending angle of 110°±20° generates the largest sound pressure.

Figure 3:
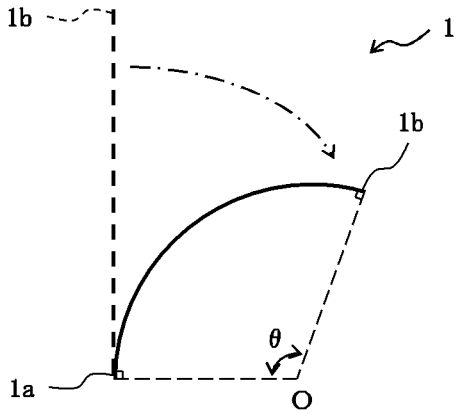
FIG. 3 is a schematic diagram which explains a curved state of a diaphragm of the universal speaker according to the present invention.

Here, as shown in FIG. 3, the bending angle of the curved surface portion is defined by intersection of a perpendicular line to the one end 1*a* side of the curved diaphragm 1 and a perpendicular line to the other end 1*b* side thereof.

In FIG. 3, a dashed line illustrates the diaphragm 1 in a flat plate state, and a solid line illustrates the diaphragm 1 in a state of being bent from the one end 1*a* side toward the other end 1*b* side opposed thereto as indicated with an arrow using a chain dashed line, so as to form the bent curved surface portion. As a consequence, the bending angle of the curved surface portion of the curved diaphragm 1 at this point is expressed by an angle θ at a point O of intersection of the perpendicular line to the one end 1*a* side and the perpendicular line to the other end 1*b* side, which falls in the range from 90° to 130°.

Meanwhile, FIG. 2 shows a state in which the curved diaphragm 1 is disposed so as to cover the opening 39 of the housing 3, and an edge portion (on the one end 1*a* side) thereof is attached in contact substantially at right angle (90°) to an upper face of an after-mentioned diaphragm driving portion 26 of the driver unit 2 that is fixedly attached to the housing 3.

Any of paper such as carbon paper, flexible plastics such as polyimide and polyester, wood materials such as balsa wood, metal such as aluminum, beryllium, and boron can be used as the material of the curved diaphragm 1. Here, the thickness of the curved diaphragm 1 is not limited to a particular thickness as long as the curved diaphragm 1 can be realized by being bent in advance to provide the curved surface portion or by being flexurally deformed.

The driver unit 2 is an actuator which vibrates the curved diaphragm 1 in accordance with an electric signal (a voice signal) that is inputted (applied), and is attached in contact to the edge portion of the curved diaphragm 1 in such a way as to be driven in the same direction as a direction of the plane of the curved diaphragm 1. Specifically, the driver unit 2 is connected to an end surface portion of the curved diaphragm 1 and attached thereto so as to apply vibration to the end surface portion of the curved diaphragm 1. Meanwhile, examples of the electric signal to be inputted to the driver unit 2 include voice signals outputted from a television, a radio, an audio player, a personal computer, a smart device such as a smartphone and a tablet, and the like.

Here, a large diaphragm or large electric power is required in order to emit a large sound. Alternatively, a large sound can also be achieved by applying a large force (vibration) from the driver unit 2 to the curved diaphragm 1. Examples of this driver unit (hereinafter simply referred to as the "driver" as appropriate) 2 include a moving magnet actuator, a moving coil actuator, and the like.

Specifically, a sound is reproduced by using either the moving magnet actuator or the moving coil actuator in order to realize a phenomenon of generating a shear wave from the curved surface portion of the curved diaphragm 1. The moving magnet actuator has advantages in design in that the moving magnet actuator can drive a diaphragm having a larger mass with an input of an electric signal in the same magnitude as that to be inputted to the moving coil actuator, and that the moving magnet actuator can easily be made smaller than the moving coil actuator at the time of driving a diaphragm having a large mass. On the other hand, the moving coil actuator has an advantage in design in that the moving coil actuator has a large stroke when driving the curved diaphragm 1 and can thus achieve a wider frequency band (range of sounds).

The driver 2 of the moving magnet type can feed a voice signal to a voice coil around the magnet, so that the magnet located at the center can vibrate while obtaining a relatively strong drive force attributed to a change in magnetic field of the voice coil, thereby increasing the sound pressure to be generated from the curved surface portion of the curved diaphragm 1.

Figure 4:
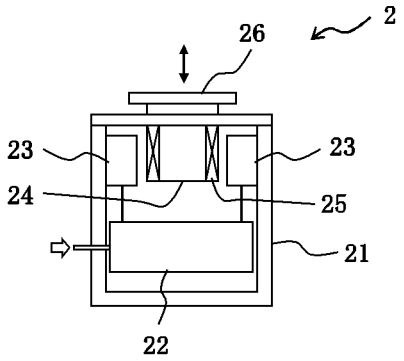
FIG. 4 is a schematic diagram which explains a structure of a driver unit of the universal speaker according to the present invention.

The driver 2 of the moving magnet type can be shown in FIG. 4, for example.

In the driver 2 of the moving magnet type shown in FIG. 4, a voice coil 23 is located on an inner wall face of a cup-like yoke 21, and a cylindrical pole piece 24 provided with a magnet (a permanent magnet) 25 is located on an inner side of the voice coil 23. Moreover, a driver circuit 22 to receive the electric signal supplied from outside is located inside the yoke 21.

The driver 2 of the moving magnet type is configured to create a magnetic gap between the voice coil 23 and an outer peripheral face of the pole piece 24 as the voice coil 23 receives electric energy from the driver circuit 22, thereby constituting a magnetic circuit.

Meanwhile, the diaphragm driving portion 26 made of metal in a disc shape is provided on an upper part of the pole piece 24, while a lower end portion of the pole piece 24 is disposed inside the magnetic gap. Specifically, the diaphragm driving portion 26 is provided at an upper tip end portion of the driver 2 while the lower end portion of the pole piece 24 is disposed in the magnetic gap of the magnetic circuit.

As described above, the driver 2 can drive the pole piece 24 that has a large mass as being of the moving magnetic type, and vibrate the diaphragm with a larger force than a force of the moving coil actuator driving a coil having a small mass. Specifically, in the case of driving the diaphragm having the large mass, the moving magnet actuator has an advantage in size as compared to the moving coil actuator, because dimensions of a housing of the moving magnet actuator can be reduced. In addition, the moving magnet actuator facilitates integration of an amplifier (the driver circuit 22) of such a magnet drive. Note that the driver circuit 22 may instead be provided outside the yoke 21 serving as the housing of the actuator. Thus, a further reduction in size is available.

By this driver 2, energy of the electric signal is transformed into kinetic energy in the form of reciprocating movement of the magnet 25 (the pole piece 24). The kinetic energy can emit the sound by applying the vibration parallel to the plane direction of the curved diaphragm 1 through the diaphragm driving portion 26. Directions of vibration of the diaphragm driving portion 26 are indicated with an arrow FIG. 4.

Note that the electric signal is an amplifier driving signal from any of not-illustrated devices including a television, a radio, an audio player, a personal computer, a smart device such as a smartphone and a tablet, and the like, which is supplied in accordance with the sound to be emitted. This electric signal is the same as an ordinary electric signal for driving an amplifier.

Figure 5A:
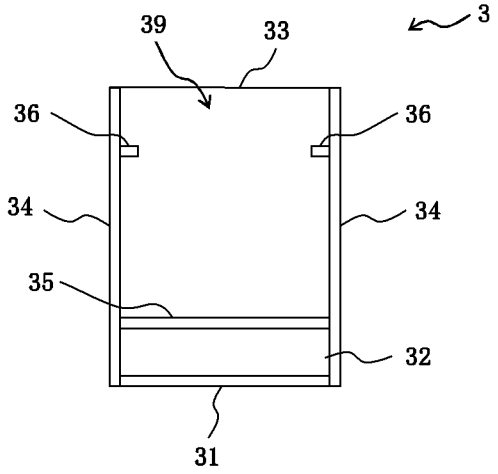
FIG. 5(*a*) is a front view and FIG. 5(*b*) is a vertical sectional view taken along a center line in a front view, which explain a structure of a housing of the universal speaker according to the present invention.
Figure 5B:
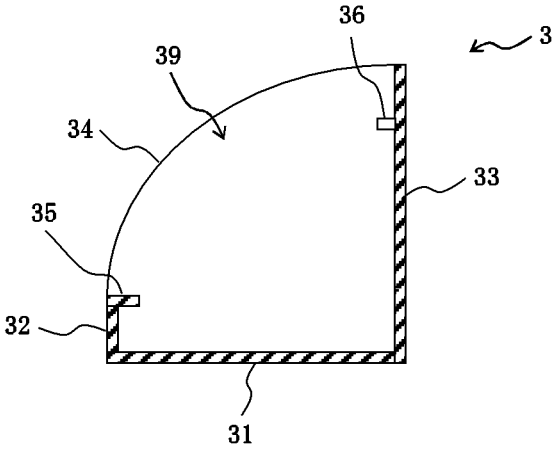

The housing 3 is a hollow structure body having a box-like shape to house the curved diaphragm 1 and the driver unit 2. As shown in FIG. 5, the housing 3 includes a bottom plate 31, a front plate 32, aback plate 33, and right and left side plates 34 and 34. The housing 3 has the opening 39 on one side.

FIG. 5 illustrates the housing 3 which is formed from: the bottom plate 31 having a rectangular shape and covering a bottom face portion; the front plate 32 having a horizontally long rectangular shape and partially covering a lower part of a front face portion; the back plate 33 having a rectangular shape and entirely covering a back face portion; and the right and left side plates 34 and 34 each having a substantially fan-like shape and covering a side face portion between the front plate 32 and the back plate 33 such that its upper edge forms an arc. Moreover, the housing 3 is illustrated as being entirely opened from a front face portion where the front plate 32 is provided toward a top face portion, thus providing the opening 39 on the one side.

Meanwhile, an upper edge of the front plate 32 is provided with an overhanging portion 35 that partially covers the diaphragm driving portion 26 side of the driver unit 2 housed therein. Moreover, fixation pieces 36 and 36 are provided in the vicinity of an upper end of the back plate 33 so as to come into contact with the right and left side plates 34, respectively.

Here, although it is not illustrated, an aperture in a horizontally long rectangular shape is provided at a lower part of the back plate 33 of the housing 3 in consideration of establishing an open state of a space on the back face side of the curved diaphragm 1 and emitting low-pitched sounds.

The driver unit 2 is fixedly attached to the inside of the housing 3. Specifically, while the driver unit 2 is subjected to a counteraction by the drive of the magnet 25 at the time of driving the curved diaphragm 1, it is possible to vibrate the housing 3 by using the drive of the curved diaphragm 1 and the counteraction and to increase the sound pressure to be emitted to the outside by causing the driver unit 2 to be in contact with and fixed to the housing 3.

In the meantime, the curved diaphragm 1 is brought into contact with and coupled to the diaphragm driving portion 26 at the upper tip end portion of the driver 2 which is fixedly attached to the inside of the housing 3. There is no problem if the curved diaphragm 1 is attached obliquely to the diaphragm driving portion 26 of the driver 2 as long as the end face portion of the curved diaphragm 1 is in contact with the diaphragm driving portion 26 of the driver 2, because the sound can be emitted even in this state. Nevertheless, in order to prevent reduction in volume, it is desirable that the end face portion of the curved diaphragm 1 come into contact with the diaphragm driving portion 26 of the driver 2 substantially at right angle. In this case, the volume reaches the maximum.

The coupling between the diaphragm driving portion 26 of the driver 2 and the curved diaphragm 1 is not limited to a particular mode as long as these components are coupled to each other while coming into contact substantially at right angle. Accordingly, the edge portion of the curved diaphragm 1 may be brought into contact with and coupled to the diaphragm driving portion 26 by using a clip 4 shown in FIG. 6, for example. The clip 4 serves as a vibration transmission fixture, which adopts a clipping structure having spring elasticity, and is configured to efficiently transmit vibration from the diaphragm driving portion 26 of the driver 2 to the curved diaphragm 1.

Figure 6A:
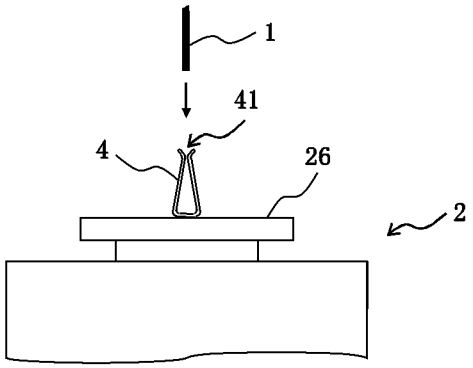
FIG. 6(*a*) is a partially enlarged side view showing a state before attachment and FIG. 6(*b*) is a partially enlarged front view showing a state after attachment, which explain first means for attaching the diaphragm to the driver unit of the universal speaker according to the present invention.
Figure 6B:
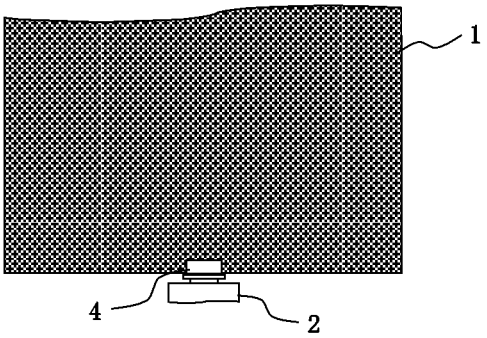

FIG. 6 shows that the clip 4 includes a mouth 41, which always retains a closed state with the spring elasticity, gets opened as appropriate when the edge portion of the curved diaphragm 1 is inserted, and thus clips and supports the curved diaphragm 1. Accordingly, FIG. 6 shows a state in which the clip 4 is fixed to an upper face of the diaphragm driving portion 26 of the driver 2 and the edge portion of the curved diaphragm 1 is inserted from above the mouth 41 of the clip 4 (see FIG. 6(*a*)), and a state in which the clip 4 supports the diaphragm driving portion 26 of the driver 2 and the edge portion of the curved diaphragm 1 in such a way as to come into contact substantially at right angle with and be coupled to each other (see FIG. 6(*b*)).

By using the clip 4 with the material or the structure having the spring elasticity as described above, a transmission loss at a junction between the diaphragm driving portion 26 and the curved diaphragm 1 is prevented. Thus, loosening or the like does not occur between the diaphragm driving portion 26 and the curved diaphragm 1 despite the long-term use, and initial energy transfer efficiency can thus be sustained.

Figure 7A:
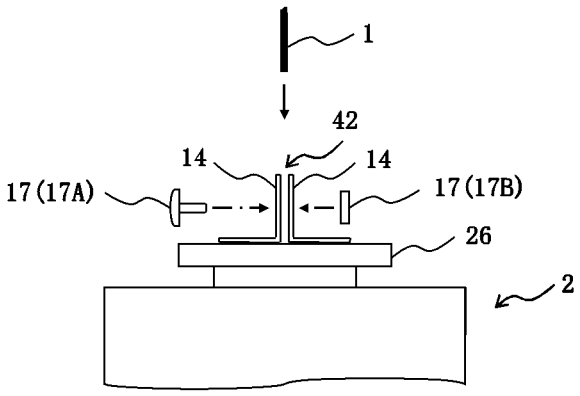
FIG. 7(*a*) is a partially enlarged side view showing a state before attachment and FIG. 7(*b*) is a partially enlarged front view showing a state after attachment, which explain second means for attaching the diaphragm to the driver unit of the universal speaker according to the present invention.
Figure 7B:
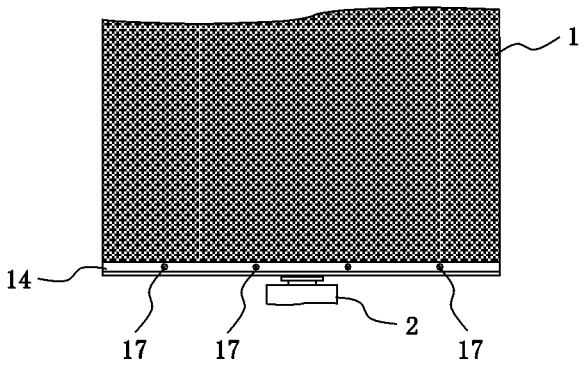

Alternatively, regarding the method of coupling the diaphragm driving portion 26 to the curved diaphragm 1, the edge portion of the curved diaphragm 1 may be brought into contact with and coupled to the diaphragm driving portion 26 by using clips 14 shown in FIG. 7, for example. The clips 14 serve as a vibration transmission fixture, which adopts a structure capable of clipping the end face portion of the curved diaphragm 1 entirely in a lateral direction and adjusting a clipping clearance thereof, and is configured to efficiently transmit the vibration from the diaphragm driving portion 26 of the driver 2 to the curved diaphragm 1.

In FIG. 7, each clip 14 is a fitting jig formed by connecting a bottom face portion to a side face portion substantially in an L-shape, and two clips 14 are paired and disposed such that the side face portions are opposed to each other with an appropriate clearance in between, thereby defining a mouth 42 that allows insertion of the edge portion of the curved diaphragm 1. Accordingly, FIG. 7 shows a state in which the clips 14 and 14 are fixed to the upper face of the diaphragm driving portion 26 of the driver 2 and the edge portion of the curved diaphragm 1 is inserted from above the mouth 42 formed from the clips 14 and 14 (see FIG. 7(*a*)), and a subsequent state in which the clips 14 and 14 support the diaphragm driving portion 26 of the driver 2 and the edge portion of the curved diaphragm 1 in such a way as to come into contact substantially at right angle with and be coupled to each other by squeezing the edge portion with fasteners 17 (17A and 17B) in such a way as to narrow down the clearance between the side face portions (see FIG. 7(*b*)). In other words, the edge portion of the curved diaphragm 1 is depicted as if the edge portion is stuck between the two plates and is fastened with screws in such a way as to come into contact substantially at right angle with the diaphragm driving portion 26 of the driver 2.

Thus, even when the thickness of the curved diaphragm 1 varies, it possible to hold the curved diaphragm 1 reliably and with an appropriate force by use of the clip 14 having the structure capable of adjusting the clipping clearance as described above, and by means of adjusting the degree of squeezing as such. Moreover, it is possible to prevent a transmission loss at the junction between the diaphragm driving portion 26 and the curved diaphragm 1, and to eliminate the loosening or the like between the diaphragm driving portion 26 and the curved diaphragm 1 despite the long-term use, thereby sustaining the initial energy transfer efficiency.

As described above, the curved diaphragm 1 is held at two points by use of the clip 4 (the clips 14) attached to the diaphragm driving portion 26 of the driver 2 and the right and left fixation pieces 36 and 36 provided on the back plate 33 of the housing 3. Thus, the curved diaphragm 1 is allowed to stretch from the front face portion to the top face portion of the housing 3 in the arc shape, and is disposed so as to cover the opening 39.

In the present invention, the curved diaphragm 1 may be designed to constitute part of the housing 3. Specifically, the curved diaphragm 1 and the housing 3 may be formed separately by using the same material and then combined with each other, or the curved diaphragm 1 may be formed integrally with the housing 3.

When the curved diaphragm 1 constitutes part of the housing 3 as described above, the part of the housing 3 serving as the curved diaphragm 1 employs the same material as the remaining part of the housing 3. Accordingly, it is possible to obtain the universal speaker which emits a larger and clearer sound that enables both a hard-of-hearing individual and a hearing individual to catch the sound comfortably, while achieving labor saving in manufacturing processes and suppressing material costs at the same time.

In the meantime, it is desirable to provide the curved diaphragm 1 in such a way that two side edge portions thereof are supported by the housing 3. Specifically, in order to support the curved diaphragm 1, each side plate 34 of the housing 3 may be provided with a curved guide protrusion and the flat diaphragm 1 may be attached along a curved surface of the guide protrusion. Accordingly, the guide protrusion also serves as a diaphragm-bending auxiliary fitting jig for efficiently bending the diaphragm 1 in the state of being the upright flat plate. Here, the two side edge portions mean side edge portions along the direction from the one end side to the other end side. Moreover, such guide protrusions 5 can be illustrated in FIG. 8, for example.

Figure 8A:
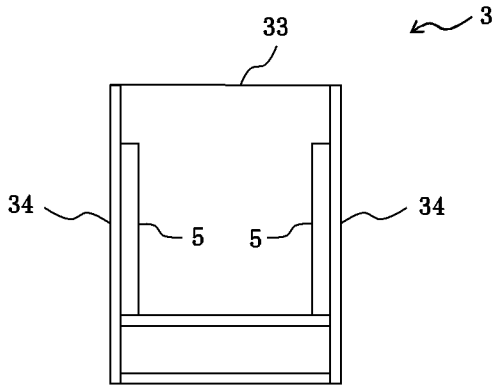
FIG. 8(*a*) is a front view and FIG. 8(*b*) is a vertical sectional view taken along a center line in a front view, which explain a state of providing guide protrusions to the housing of the universal speaker according to the present invention.
Figure 8B:
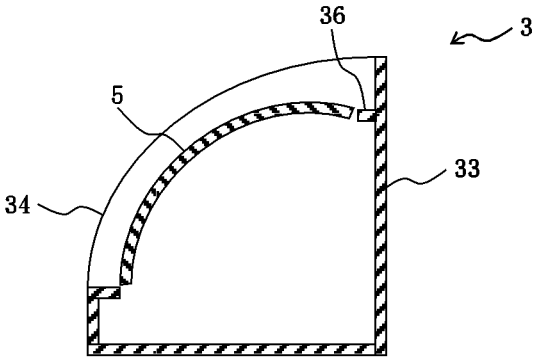

In FIG. 8, the guide protrusions 5 are illustrated as arc-shaped protruding pieces, each of which is formed into an arc shape that extends obliquely upward from the front face portion to the top face portion of the housing 3. Here, the guide protrusions 5 are depicted as being attached to inner faces of the right and left side plates 34 and 34 of the housing 3, respectively.

Accordingly, in the case where the guide protrusions 5 each formed into the bent shape so as to provide the prescribed curved surface are attached to the inner faces of the side plates 34 of the housing 3 and the diaphragm 1 is easily bent from the one end side to the other end side opposed thereto when the diaphragm 1 in the flat and upright state is bent for the purpose of generating the shear wave, it is desirable that the side edge portions of the diaphragm 1 be supported by upper faces of the guide protrusions 5 attached to the housing 3.

By using the guide protrusions 5 as described above, the diaphragm 1 in the upright state attached to the driver 2 can be easily bent along the upper faces of the guide protrusions 5, and the curved diaphragm 1 can be provided in such a way as to be easily formed into the curved surface portion that is bent from the one end side to the other end side opposed thereto. Moreover, since the two side edge portions of the curved diaphragm 1 are supported by the housing 3, it is possible to reduce a risk of reduction in energy transfer efficiency while preventing the curved diaphragm 1 from being affected by an external force or the like.

Figure 9:
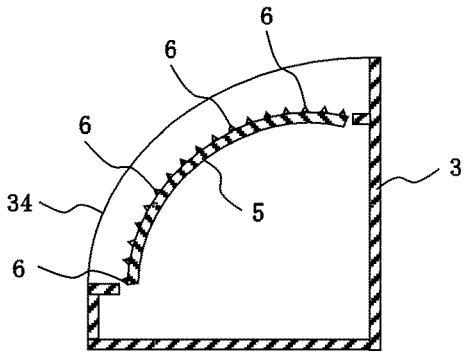
FIG. 9 is a vertical sectional view taken along a center line in a front view, which explains a state of providing support members for the diaphragm onto upper faces of the guide protrusions provided to the housing shown in FIG. 8.

In the meantime, when the guide protrusions 5 are provided in such a way that the two side edge portions of the curved diaphragm 1 are supported by the housing 3, numerous edge support members 6 called spikes or insulators and each having a conical shape, a triangular pyramid shape, or a hemispherical shape may be disposed on the upper faces of the guide protrusions 5 as shown in FIG. 9, for example, so as to cause the edge support members 6 to support the curved diaphragm 1 partially by point contact. Specifically, the two side edge portions of the curved diaphragm 1 can be supported by the housing 3 through the edge support members 6 and the guide protrusions 5. The edge support members 6 are formed from an elastic material such as rubber, or a hard material such as a wood material, a stone material, and a metal material.

In FIG. 9, the edge support members 6 are depicted as having the conical shape, and seventeen pieces of the edge support members 6 are disposed at regular intervals in such a way as to protrude from the upper face of the guide protrusion 5 attached to the side plate 34 of the housing 3. Note that the number of the edge support members 6 is not limited to a particular value, and an appropriate number of the edge support members 6 may be provided.

By causing the housing 3 to support the curved diaphragm 1 through the edge support members 6 as described above, the curved diaphragm 1 vibrates relatively freely. On the other hand, vibration energy of the curved diaphragm 1 is either absorbed or released by using the edge support members 6, and the vibration is less likely to be transmitted to the housing 3. Thus, it is possible to reduce the energy loss.

Here, although it is not illustrated, when the curved diaphragm 1 is supported partially by point contact, the edge support members 6 may be directly attached to the side plates 34 of the housing 3 in such a way as to protrude inward from the side plates 34. In this case, the shape of the edge support members 6 is not limited only to any of the conical shape, the triangular pyramid shape, and the hemispherical shape, but may also adopt a cylindrical shape.

Figure 10A:
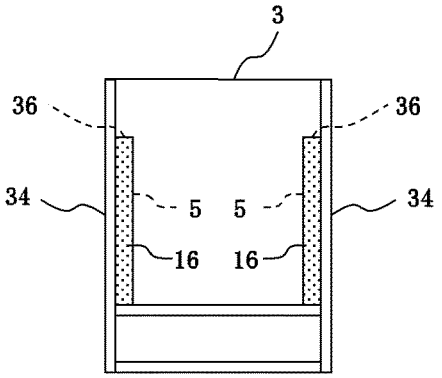
FIG. 10(*a*) is a front view and FIG. 10(*b*) is a vertical sectional view taken along a center line in a front view, which explain a state of providing buffer members for the diaphragm onto the upper faces of the guide protrusions provided to the housing shown in FIG. 8.
Figure 10B:
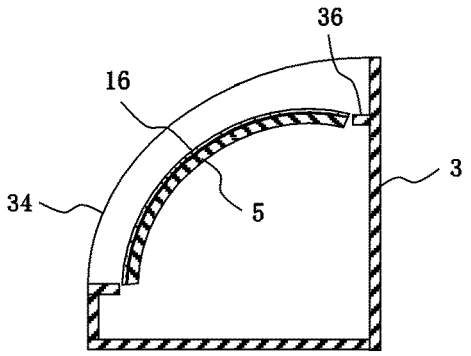

Meanwhile, when the guide protrusions 5 are provided in such a way that the two side edge portions of the curved diaphragm 1 are supported by the housing 3, vibration buffer members 16 having a function to prevent occurrence of abnormal noise, which is attributed to contact between the curved diaphragm and the guide portions, and the like may be disposed on the upper faces of the guide protrusions 5 as shown in FIG. 10, for example, so as to cause the vibration buffer members 16 to support the curved diaphragm 1 by line contact.

A soft and vibration-insulative material is applicable to the vibration buffer members 16. Each side edge portion of the curved diaphragm 1 is in close contact with the corresponding vibration buffer member 16 on the guide protrusion 5. Examples of such a vibration buffer member 16 include a sheet member which is rich in elasticity, such as urethane foam resin, rubber, and unwoven fabrics.

In FIG. 10, each vibration buffer member 16 is depicted as having a strip shape, being provided so as to cover the upper face of the guide protrusion 5 attached to the side plate 34 of the housing 3, and assisting in formation of an enclosed space between the curved diaphragm 1 and housing 3.

By supporting the curved diaphragm 1 through the vibration buffer members 16 as described above, the curved diaphragm 1 vibrates relatively freely. On the other hand, vibration energy of the curved diaphragm 1 is less likely to be transferred to the housing 3 by use of the vibration buffer members 16. Thus, it is possible to reduce the energy loss. Moreover, since the enclosed space is formed between the curved diaphragm 1 and the housing 3, the vibration buffer members 16 block sound waves emitted from a surface (a front face) of the diaphragm and sound waves emitted from a back surface (a rear face) thereof, and can thus eliminate occurrence of interference and attenuation of the sound waves on the surface and the back surface, thereby obtaining a stable sound pressure and a wide frequency band characteristic.

Figure 11:
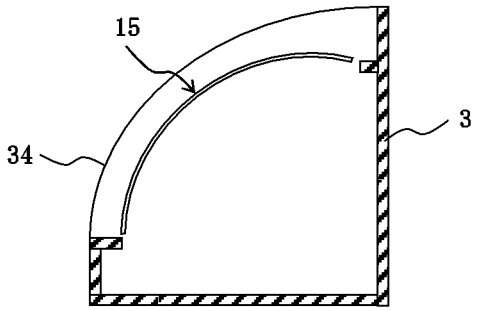
FIG. 11 is a vertical sectional view taken along a center line in a front view, which explains a state of providing a guide recess to the housing of the universal speaker according to the present invention.

Meanwhile, when the two side edge portions of the curved diaphragm 1 are arranged to be supported by the housing 3, slit-like guide recesses 15 may be provided in the inner faces of the side plates 34 of the housing 3 instead of the guide protrusions 5, and the curved diaphragm 1 may be supported in such a way as to insert the side edge portions into the guide recesses 15 as shown in FIG. 11, for example. Specifically, each guide recess 15 is formed slightly wider than a thickness of the curved diaphragm 1 and designed to pinch the corresponding side edge portion of the curved diaphragm 1 in a clearance thereof. Thus, the curved diaphragm 1 is supported by the housing 3 through the guide recesses 15.

In FIG. 11, each guide recess 15 is illustrated as an arc-shaped groove, which is formed into an arc shape that extends obliquely upward from the front face portion to the top face portion of the housing 3 as with the guide protrusions 5. Here, the guide recesses 15 are depicted as being formed in the inner faces of the right and left side plates 34 and 34 of the housing 3, respectively.

By supporting the curved diaphragm 1 through the guide recesses 15 as described above, the curved diaphragm 1 can vibrate relatively freely without being fixed to the housing 3. On the other hand, the vibration energy of the curved diaphragm 1 is less likely to be transferred to the housing 3 by use of the guide recesses 15. Thus, it is possible to reduce the energy loss.

Here, although it is not illustrated, when the curved diaphragm 1 is supported through the guide recesses 15, the side plates 34 may be provided with the guide protrusions 5 in addition to the guide recesses 15, and the two side edge portions of the curved diaphragm 1 may be supported by the housing 3 through the guide recesses 15 and the guide protrusions 5.

Furthermore, the side plates 34 may be provided with the guide recesses 15 and the guide protrusions 5, and moreover, the numerous edge support members 6 may be disposed on the upper faces of the guide protrusions 5 so as to cause the edge support members 6 to support lower parts of the side edge portions of the curved diaphragm 1 partially by point contact, while causing the guide recesses 15 to support the side edge portions of the curved diaphragm 1 in such a way as to allow insertion of the side edge portions.

Figure 12:
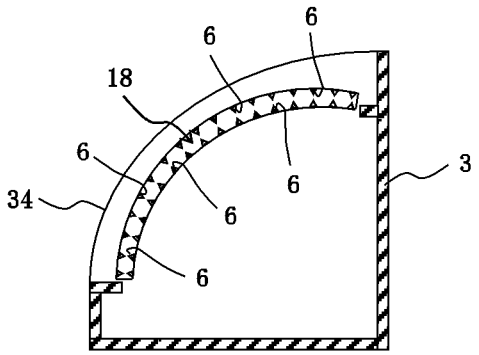
FIG. 12 is a vertical sectional view taken along a center line in a front view, which explains a state of providing a recess for support members to the housing of the universal speaker according to the present invention, and arranging the support members therein.

Meanwhile, when the curved diaphragm 1 is supported by the housing 3 in such a way as to insert the side edge portions into recesses, recessed guide portions having a large width (wide guide recesses) 18 may be provided in the inner faces of the side plates 34 of the housing 3, while the numerous edge support members 6 mentioned above may be disposed on upper faces and lower faces inside the wide guide recesses 18, and the curved diaphragm 1 may be supported by point contact in such a way as to insert the curved diaphragm 1 into clearances between the edge support members 6 as shown in FIG. 12, for example.

In FIG. 12, each wide guide recess 18 is illustrated as a wide arc-shaped groove, which is formed into an arc shape that extends obliquely upward from the front face portion to the top face portion of the housing 3 as with the guide recesses 15. Here, the wide guide recesses 18 are depicted as being formed in the inner faces of the right and left side plates 34 and 34 of the housing 3, respectively. Moreover, seventeen pieces of the edge support members 6 are depicted as being disposed on the upper face inside each wide arc-shaped groove at regular intervals in such a way as to protrude downward, and seventeen pieces of the edge support members 6 are depicted as being disposed on the lower face inside the wide arc-shaped groove at regular intervals in such a way as to protrude upward.

By supporting the two side edge portions of the curved diaphragm 1 in the clearances between the edge support members 6 provided in the two vertical lines inside the wide guide recesses 18 as described above, the curved diaphragm 1 can vibrate relatively freely. On the other hand, the vibration energy of the curved diaphragm 1 is less likely to be transferred to the housing 3 by use of the edge support members 6. Thus, it is possible to reduce the energy loss.

Meanwhile, the universal speaker of the present invention is not limited only to the combination of the single drive unit and the single curved diaphragm as in the above-described configuration, but can also adopt various other combinations.

For example, multiple curved diaphragms 1 may be attached to the driver unit 2 and the curved diaphragms 1 may be made of materials that are different from each other. Specifically, as shown in FIG. 13, a universal speaker 20 can have a structure in which two curved diaphragms 11A and 11B having the same size but being made of materials different from each other are attached to the diaphragm driving portion 26 of the driver 2.

Figure 13:
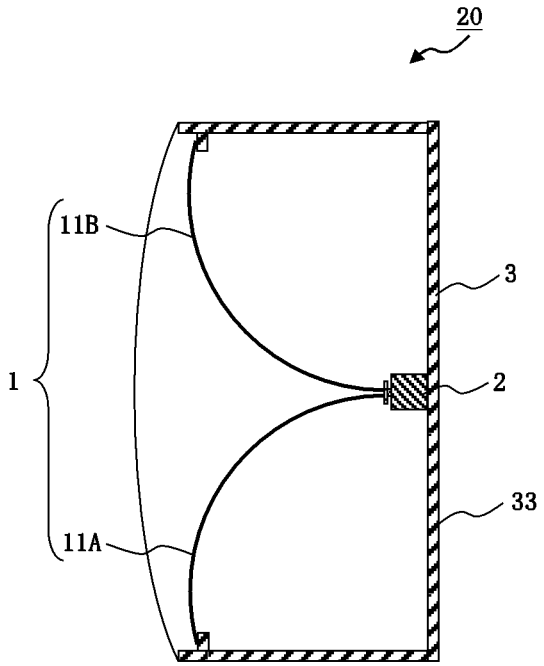
FIG. 13 is a vertical sectional view taken along a center line in a front view illustrating another structure of the universal speaker according to the present invention, which shows a state of attaching two diaphragms to one driver unit.

In FIG. 13, the driver 2 is depicted as being fixedly attached to the back plate 33 of the housing 3, and each of the two curved diaphragms 11A and 11B is depicted as being provided so as to cover the opening 39 of the housing 3, with its edge portion being brought into contact substantially at right angle with the diaphragm driving portion 26 of the driver 2.

It is expected from the above-described universal speaker 20 that high to middle-pitched sounds are reproduced by using the curved diaphragm 1 made of a hard material while low-pitched sounds are reproduced by using the curved diaphragm 1 made of a soft material, or that high to middle-pitched sounds are reproduced by using the curved diaphragm 1 made of a light material while middle to low-pitched sounds are reproduced by using the curved diaphragm 1 made of a heavy material.

Meanwhile, the universal speaker of the present invention may be configured such that multiple curved diaphragms 1 are attached to the driver unit 2 and bending angles of the curved diaphragms 1 are different from each other. Specifically, a universal speaker 30 can have a structure in which two curved diaphragms 11A and 11C being made of the same material but having bending angles different from each other are attached to the diaphragm driving portion 26 of the driver 2 as shown in FIG. 14.

Figure 14:
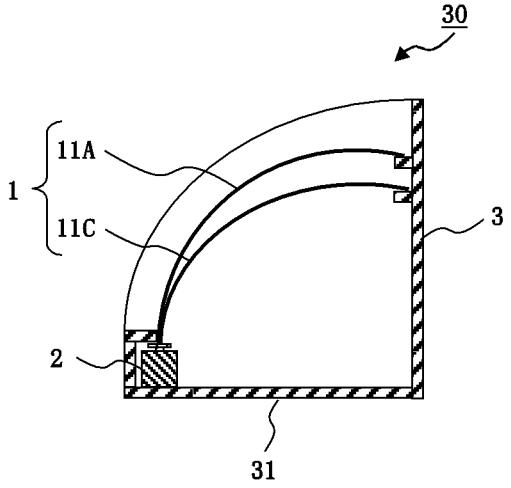
FIG. 14 is a vertical sectional view taken along a center line in a front view illustrating another structure of the universal speaker according to the present invention, which shows a state of attaching two diaphragms having different bending angles to one driver unit.

In FIG. 14, the driver 2 is depicted as being fixedly attached to the bottom plate 31 of the housing 3, and each of the two curved diaphragms 11A and 11C having the different bending angles is depicted as being provided so as to cover the opening 39 of the housing 3, with its edge portion being brought into contact substantially at right angle with the diaphragm driving portion 26 of the driver 2.

It is expected from the above-described universal speaker 30 that high to middle-pitched sounds are reproduced by using the curved diaphragm 11C having the large bending angle while middle to low-pitched sounds are reproduced by using the curved diaphragm 11A having the small bending angle.

In the meantime, the universal speaker of the present invention may be configured such that multiple curved diaphragms 1 are attached to the driver unit 2 and the curved diaphragms 1 have sizes that are different from each other. Specifically, since a reproduction frequency band varies depending on dimensions of the curved diaphragm 1, a universal speaker 40 can have a structure in which two curved diaphragms 11A and 11D being made of the same material but having sizes different from each other are attached, respectively, to the diaphragm driving portion 26 of the driver 2 as shown in FIG. 15.

Figure 15:
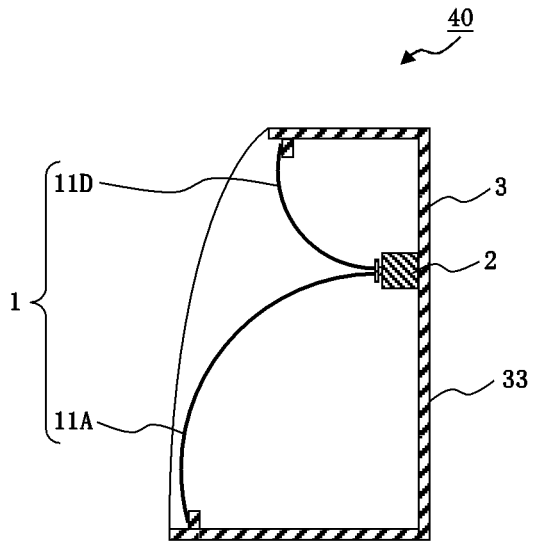
FIG. 15 is a vertical sectional view taken along a center line in a front view illustrating another structure of the universal speaker according to the present invention, which shows a state of attaching two diaphragms having different sizes to one driver unit.

In FIG. 15, the driver 2 is depicted as being fixedly attached to the back plate 33 of the housing 3, and each of the two curved diaphragms 11A and 11D having the different sizes is depicted as being provided so as to cover the opening 39 of the housing 3, with its edge portion being brought into contact substantially at right angle with the diaphragm driving portion 26 of the driver 2.

The above-described universal speaker 40 is configured to expand a reproduction frequency range by attaching the curved diaphragms 1 having the different dimensions to the same driver unit 2 when the reproduction range of the sound does not sufficiently expand due to the materials and the bending angles of the curved diaphragm 1. Accordingly, it is expected from the universal speaker 40 that high to middle-pitched sounds are reproduced by using the curved diaphragm 11D having the small size while middle to low-pitched sounds are reproduced by using the curved diaphragm 11A having the large size.

Meanwhile, the universal speaker of the present invention may be configured such that multiple driver units 2 are attached to one end side of the curved diaphragm 1. Specifically, a universal speaker 50 can have a structure in which three driver units 2 are attached to the curved diaphragm 1 as shown in FIG. 16.

Figure 16:
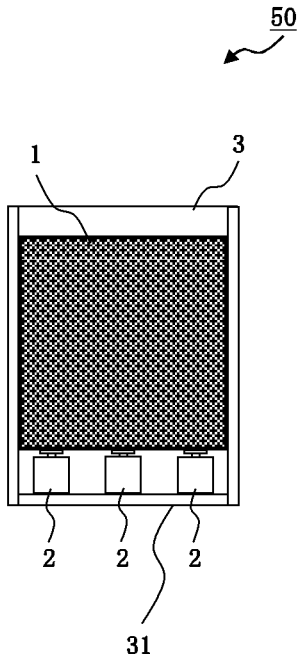
FIG. 16 is a vertical sectional view taken along a center line in a front view illustrating another structure of the universal speaker according to the present invention, which shows a state of attaching three driver units to one diaphragm.

In FIG. 16, the three drivers 2 are depicted as being fixedly attached to the bottom plate 31 of the housing 3, respectively, and the curved diaphragm 1 is depicted as being provided so as to cover the opening 39 of the housing 3, with an edge portion thereof being brought into contact substantially at right angle with the diaphragm driving portions 26 of all the drivers 2.

By driving an end face portion of the same curved diaphragm 1 with the three driver units 2, the above-described universal speaker 50 is capable of driving voice energy with the multiple driver units 2, which would face with an upper limit if using just one driver unit 2, thereby generating a larger shear wave or sparse-dense wave with the curved diaphragm 1. Thus, it is expected to emit a large and clear sound.

Figure 17:
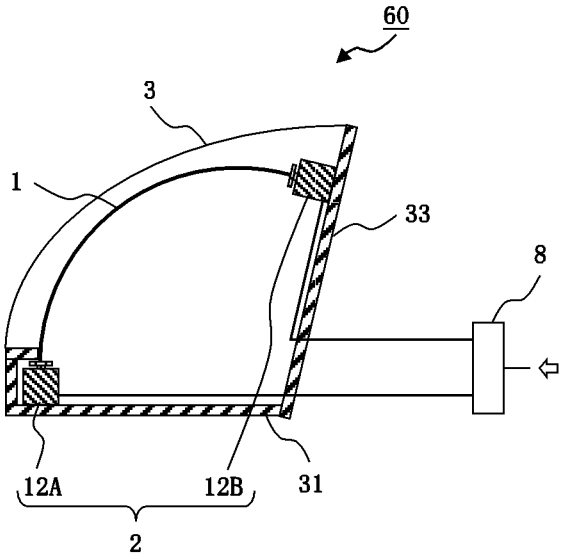
FIG. 17 is a vertical sectional view taken along a center line in a front view illustrating another structure of the universal speaker according to the present invention, which shows a state of attaching driver units to one end side and another end side of one diaphragm, respectively, and providing means for splitting an electric signal to be inputted to the respective driver units into two frequency bands.

In the meantime, the universal speaker of the present invention may be configured such that a drive unit 2 is additionally attached to another end side of the curved diaphragm 1. Specifically, as shown in FIG. 17, a universal speaker 60 can have a structure in which a first driver 12A is attached to the one edge portion of the curved diaphragm 1 and a second driver 12B is attached to the other edge portion thereof. To be more precise, both the first driver 12A and the second driver 12B may be formed from moving magnet actuators, or both the first driver 12A and the second driver 12B may be formed from moving coil actuators. Alternatively, anyone of the first driver 12A and the second driver 12B may be formed from a moving magnet actuator while the other one may be formed from a moving coil actuator.

In FIG. 17, the first driver 12A is depicted as being fixedly attached to the bottom plate 31 of the housing 3, and the second driver 12B is depicted as being fixedly attached to the back plate 33 of the housing 3, respectively. Moreover, the curved diaphragm 1 is depicted as being provided so as to cover the opening 39 of the housing 3, with the one edge portion thereof being brought into contact substantially at right angle with the diaphragm driving portion 26 of the first driver 12A, and the other edge portion thereof being brought into contact substantially at right angle with the diaphragm driving portion 26 of the second driver 12B, respectively.

By driving different end face portions of the curved diaphragm 1 with the different driver units 12A and 12B, respectively, the above-described universal speaker 60 is capable of driving sound generation energy with the multiple driver units 2 (12A and 12B), which would face with an upper limit if using just one driver unit, thereby generating a larger shear wave or sparse-dense wave from the curved diaphragm 1. Thus, it is expected to emit a large and clear sound.

In addition, the above-described universal speaker 60 further includes means for splitting an electric signal into multiple frequency bands, which is configured to input electric signals thus split to the different driver units 12A and 12B, respectively. Specifically, as indicated with an arrow in FIG. 17, a band of a single voice signal to be inputted to the driver units 2 (12A and 12B) are split into two frequency bands by using a voice signal splitter 8 such as an analog or electronic filter, and one of outputs is inputted to the first driver 12A while the other output is inputted to the second driver 12B. Then, the single curved diaphragm 1 is thus driven. In this way, it is possible to obtain shear waves or sparse-dense waves having different reproduction bands simultaneously at the one end side and the other end side of the curved diaphragm 1, and thus to obtain a shear wave or sparse-dense wave having a wide reproduction range as a whole.

Figure 18:
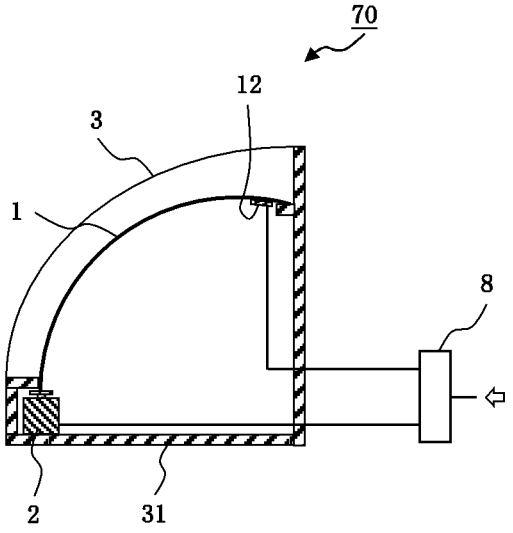
FIG. 18 is a vertical sectional view taken along a center line in a front view illustrating another structure of the universal speaker according to the present invention, which shows a state of attaching driver units having different structures to one end side and another end side of one diaphragm, respectively, and providing means for splitting an electric signal to be inputted to the respective driver units into two frequency bands.

Meanwhile, the universal speaker of the present invention may be configured such that one of the driver units 2 includes an actuator that utilizes a piezoelectric body. The piezoelectric body is a substance having a piezoelectric effect, with which upon application of a pressure, the substance per se is deformed in proportion to the pressure. The actuator is a piezoelectric element utilizing the piezoelectric effect that transforms an applied voltage into a force. The piezoelectric element expands and contracts (vibrates) in one direction when a voltage is applied thereto. Accordingly, as shown in FIG. 18, a universal speaker 70 can have a structure in which the driver unit 2 of a moving magnet type or the like is attached to the one edge portion of the curved diaphragm 1 and a piezoelectric element 12 is attached to the other edge portion thereof. To be more precise, any one of the first driver 12A and the second driver 12B may be formed from a moving magnet actuator while the other one may be formed from a piezoelectric body, or any one of the first driver 12A and the second driver 12B may be formed from a moving coil actuator while the other one may be formed from a piezoelectric body. The piezoelectric element 12 can be formed from a ceramic, a polymer such as PVDF (polyvinylidene fluoride), a composite of the ceramic and the polymer, and the like.

In FIG. 18, the one driver 2 is depicted as being fixedly attached to the bottom plate 31 of the housing 3, while the curved diaphragm 1 is depicted as being provided so as to cover the opening 39 of the housing 3, with the one edge portion thereof being brought into contact substantially at right angle with the diaphragm driving portion 26 of the one driver 2.

In addition, the above-described universal speaker 70 further includes the voice signal splitter 8 configured to split an electric signal into multiple frequency bands, and to input electric signals thus split to the different driver units 12A and 12B, respectively. Specifically, as indicated with an arrow in FIG. 18, a band of a single voice signal to be inputted to the driver units 2 and 12 are split into two frequency bands by using the voice signal splitter 8. Then, one of outputs is inputted to the first driver 2 and the other output is inputted to the second driver 12, and the one curved diaphragm 1 is thus driven.

By attaching the piezoelectric element to the edge portion of the curved diaphragm 1 as described above, variations of the piezoelectric element are efficiently transmitted to the curved diaphragm 1. Hence, an effect in reproducing high-pitch sounds is obtained in particular. Accordingly, by attaching the driver unit 2 of the moving magnet type or the like to the one edge portion of the curved diaphragm 1 and attaching the piezoelectric element 12 to the other edge portion thereof, middle to low-pitched sounds are reproduced by using a portion of the curved diaphragm 1 to which the driver unit 2 of the moving magnet type or the like is attached, while high to middle-pitched sounds are reproduced by using a portion of the curved diaphragm 1 to which the piezoelectric element 12 is attached. Thus, it is expected to obtain a shear wave or sparse-dense wave having a wide reproduction range as a whole.

In the meantime, the universal speaker of the present invention may include two driver units and two curved diaphragms. Here, two sets each prepared by combining one driver unit with one curved diaphragm may be provided in one housing. Specifically, as shown in FIG. 19, a universal speaker 80 can have a structure in which a first curved diaphragm 11A large in size is attached to the first driver unit 12A and a second curved diaphragm 11D small in size is attached to the second driver unit 12B.

In addition, the above-described universal speaker 80 further includes the voice signal splitter 8 configured to split an electric signal into multiple frequency bands, and to input electric signals thus split to the different driver units 12A and 12B, respectively.

Figure 19:
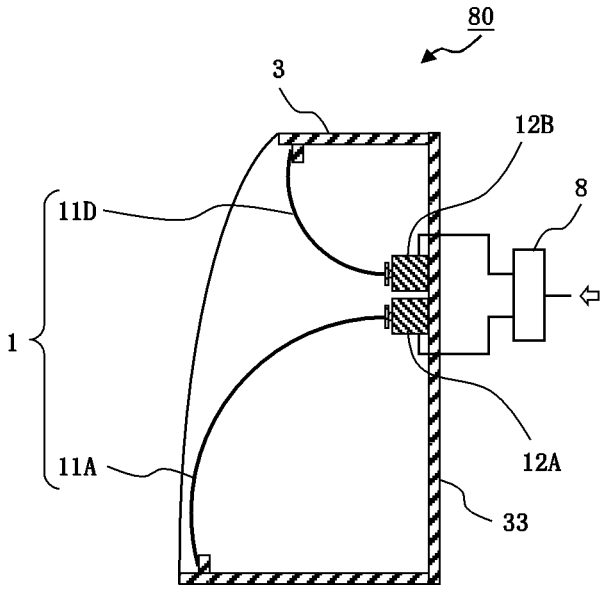
FIG. 19 is a vertical sectional view taken along a center line in a front view illustrating another structure of the universal speaker according to the present invention, which shows a state of providing two diaphragms having different sizes, attaching driver units to the diaphragms, respectively, and providing means for splitting an electric signal to be inputted to the respective driver units into two frequency bands.

In FIG. 19, the two drivers 12A and 12B are depicted as being fixedly attached to the back plate 33 of the housing 3, respectively, and the two curved diaphragms 11A and 11D are depicted as being provided so as to cover the opening 39 of the housing 3, with an edge portion of the large first curved diaphragm 11A being brought into contact substantially at right angle with the diaphragm driving portion 26 of the first driver unit 12A, and an edge portion of the small second curved diaphragm 11D being brought into contact substantially at right angle with the diaphragm driving portion 26 of the second driver unit 12B, respectively.

By driving end faces of the curved diaphragms 11A and 11D having the different shapes, respectively, with the specific driver units 12A and 12B different from each other, the above-described universal speaker 80 is capable of appropriately transforming the sound generation energy with the multiple driver units 2 (12A and 12B) and the multiple curved diaphragms 11A and 11D, respectively, which would face with an upper limit if using just one driver unit and one curved diaphragm, thereby generating larger shear waves or sparse-dense waves from the curved diaphragms 11A and 11D, respectively. Thus, it is expected to emit a large and clear sound in response to a range of sounds.

Furthermore, the universal speaker of the present invention may include two driver units and two curved diaphragms. Here, two sets each prepared by combining one driver unit with one curved diaphragm may be provided in one housing. Moreover, one of the driver units may include an actuator that utilizes a piezoelectric body. Specifically, as shown in FIG. 20, a universal speaker 90 can have a structure in which a first driver unit is formed as the moving magnet type and the curved diaphragm 11A large in size is attached to this driver unit 2, and a second driver unit is formed from the piezoelectric element 12 and the curved diaphragm 11D small in size is attached to this driver unit 12.

In addition, the above-described universal speaker 90 further includes the voice signal splitter 8 configured to split an electric signal into multiple frequency bands, and to input electric signals thus split to the different driver units 2 and 12, respectively.

Figure 20:
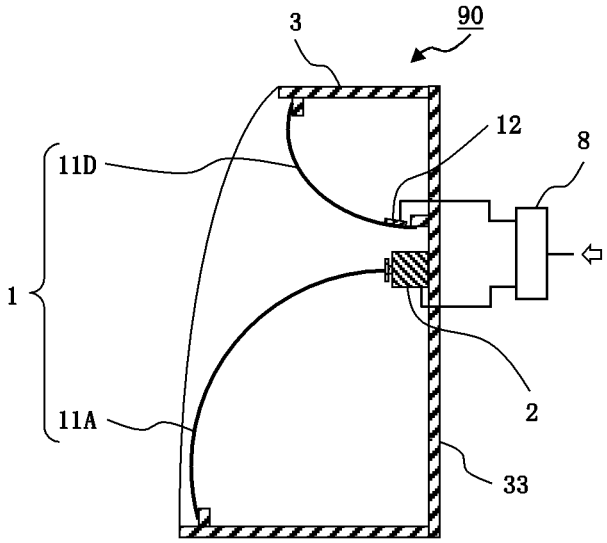
FIG. 20 is a vertical sectional view taken along a center line in a front view illustrating another structure of the universal speaker according to the present invention, which shows a state of providing two diaphragms having different sizes, attaching driver units having different structures to the diaphragms, respectively, and providing means for splitting an electric signal to be inputted to the respective driver units into two frequency bands.

In FIG. 20, the first driver unit 2 is depicted as being fixedly attached to the back plate 33 of the housing 3, and the two curved diaphragms 11A and 11D are depicted as being provided so as to cover the opening 39 of the housing 3, with an edge portion of the large first curved diaphragm 11A being brought into contact substantially at right angle with the diaphragm driving portion 26 of the first driver unit 2.

By driving the end faces of the curved diaphragms 11A and 11D having the different shapes, respectively, with the specific driver units 2 and 12 different from each other, the above-described universal speaker 90 is capable of appropriately transforming the sound generation energy with the multiple driver units 2 and 12 and the multiple curved diaphragms 11A and 11D, respectively, which would face with an upper limit if using just one driver unit and one curved diaphragm, thereby generating larger shear waves or sparse-dense waves from the curved diaphragms 11A and 11D, respectively. As a consequence, by attaching the driver unit 2 of the moving magnet type or the like to the edge portion of the first curved diaphragm 11A and attaching the piezoelectric element 12 to the edge portion of the second curved diaphragm 11D, middle to low-pitched sounds are reproduced by using the curved diaphragm 11A to which the driver unit 2 of the moving magnet type is attached, while high to middle-pitched sounds are reproduced by using the curved diaphragm 11D to which the piezoelectric element 12 is attached. Thus, it is expected to emit a large and clear sound in response to a range of sounds.

Here, although it is not illustrated, in the present invention, fittings may be provided for tightly fixing the driver unit 2 to the plates at the side face portions, the bottom face portion, and the like of the housing 3. Thus, even after the driver unit 2 is installed at a center position of the driver unit 2, the driver unit 2 may be rendered freely adjustable in a range within X mm in the right-left direction and in a range within X mm in the front-back direction, so as to continue its retention firmly.

EXAMPLES

Next, evaluations were conducted in order to confirm effects of the universal speakers of the present invention.

Example 1

In this example, a driver unit of a moving magnet type was fixedly attached to a bottom plate portion inside a wooden housing of a hollow structure provided with guide protrusions. In addition, an edge portion of a diaphragm made of celluloid and having a flat plate shape was brought into contact with and attached to a diaphragm driving portion of the driver unit. Meanwhile, the diaphragm was bent along the guide protrusions and was thus formed into a curved surface portion which was bent at 110°, and a universal speaker provided with the curved diaphragm provided in such a way as to cover an opening of the housing was thus formed. Then, an evaluation test was conducted by use of the universal speaker, testing whether or not a voice audible to hard-of-hearing individuals and hearing individuals was emitted.

In the evaluation test, a total of 224 individuals consisting of 31 hard-of-hearing individuals and 193 hearing individuals were invited as panelists. A voice signal outputted from an earphone jack of an audio player was inputted to the driver unit of the universal speaker of this example, and impressions of the emitted voice were evaluated.

Among the evaluations, an evaluation as being well audible was indicated with "A", an evaluation as being audible but with the feeling of being small was indicated with "B", an evaluation as being sometimes audible and sometimes inaudible was indicated with "C", and an evaluation as being hardly audible or completely inaudible was indicated with "F". The result of evaluation is shown in [Table 1].

Here, the breakdown of the hard-of-hearing individuals by age bracket consisted of 21 individuals in the nineties, 6 individuals in the eighties, 3 individuals in the sixties, and 1 individual in the thirties.

TABLE 1

| EVALUATION (IMPRESSION OF VOICE) | HARD-OF-HEARING INDIVIDUALS (HEADCOUNT) | HEARING INDIVIDUALS (HEADCOUNT) |
|---|---|---|
| A (WELL AUDIBLE) | 16 | 193 |
| B (AUDIBLE BUT SMALL) | 7 | 0 |
| C (SOMETIMES INAUDIBLE) | 3 | 0 |
| F (INAUDIBLE) | 5 | 0 |

From the result in Table 1, the universal speaker of the present invention turns out to be the one which emits a large and clear sound that enables both a hard-of-hearing individual and a hearing individual to catch the sound comfortably.

Example 2

Next, in order to confirm the fact that the bending angle of the curved surface portion of the curved diaphragm is preferably set to an angle slightly greater than 90°, the universal speakers of Example 1 were prepared by setting various bending angles of the curved surface portions of the curved diaphragms, namely, 0°, 45°, 90°, 110°, 130°, and 180°. Using these universal speakers, a test was conducted for evaluating how a voice audible to a hard-of-hearing individual and a hearing individual varies depending on the bending angle of the curved surface portion of the curved diaphragm. The result of evaluation is shown in [Table 2].

Here, the number of panelists and the evaluation method were the same as those in Example 1 mentioned above. Moreover, the result of Example 1 mentioned above was used as the evaluation in the case where the bending angle of the curved surface portion of the curved diaphragm was equal to 110°.

TABLE 2

| BENDING ANGLE OF CURVED DIAPHRAGM | EVALUATION | HARD-OF-HEARING INDIVIDUALS (HEADCOUNT) | HEARING INDIVIDUALS (HEADCOUNT) |
|---|---|---|---|
| 0° | A | 0 | 0 |
| | B | 2 | 193 |

TABLE 2-continued

| BENDING ANGLE OF CURVED DIAPHRAGM | EVALUATION | HARD-OF-HEARING INDIVIDUALS (HEADCOUNT) | HEARING INDIVIDUALS (HEADCOUNT) |
|---|---|---|---|
| | C | 4 | 0 |
| | F | 25 | 0 |
| 45° | A | 0 | 45 |
| | B | 4 | 148 |
| | C | 6 | 0 |
| | F | 21 | 0 |
| 90° | A | 2 | 113 |
| | B | 6 | 80 |
| | C | 17 | 0 |
| | F | 6 | 0 |
| 110° | A | 16 | 193 |
| | B | 7 | 0 |
| | C | 3 | 0 |
| | F | 5 | 0 |
| 130° | A | 16 | 180 |
| | B | 7 | 12 |
| | C | 3 | 0 |
| | F | 5 | 0 |
| 180° | A | 6 | 52 |
| | B | 5 | 141 |
| | C | 7 | 0 |
| | F | 13 | 0 |

From the result in Table 2, the universal speaker of the present invention turns out to be capable of efficiently transferring kinetic energy, being transformed from electric energy of the voice signal, to the curved diaphragm and thereby emitting a larger and clearer sound when the bending angle of the curved surface portion of the curved diaphragm falls in the range from 90° to 130°.

Example 3

Next, impressions of voices emitted by using the same universal speaker as the one in Example 1 mentioned above were individually evaluated by a person with an aging-related hearing difficulty. The subject is an 82-year-old male with the aging-related hearing difficulty, who uses a hearing aid regularly.

The subject was requested to take the hearing aid off. In this state, a voice signal outputted from an earphone jack of an audio player was inputted to the driver unit of the universal speaker and was then emitted therefrom. He answered that he could hear a high-pitched sound clearly.

In the meantime, a voice signal outputted from an earphone jack of a television was inputted to the driver unit of the universal speaker and was then emitted therefrom. He answered that he could again hear it clearly. Thereafter, a jack of the universal speaker was pulled off the earphone jack and the sound was emitted from a speaker of the television. He answered that he could not hear anything at all and could not recognize any human voices.

Example 4

Next, an impression of a voice emitted by using the same universal speaker as the one in Example 1 mentioned above was individually evaluated by a person with an organic hearing difficulty. The subject is a female in the thirties with the organic hearing difficulty from a young age.

A voice signal outputted from an earphone jack of an audio player was inputted to the driver unit of the universal speaker and was then emitted therefrom. She answered that she could hear every range without feeling any stress. In addition, she was noticeably delighted and answered that she has got excited and felt very hopeful.

Example 5

Next, an impression of a voice emitted by using the same universal speaker as the one in Example 1 mentioned above was individually evaluated by a person with a hereditary hearing difficulty. The subject is a 65-year-old male with a congenitally weak hearing ability, who uses a hearing aid from his youth.

The subject was requested to take the hearing aid off. In this state, a voice signal outputted from an earphone jack of a radio was inputted to the driver unit of the universal speaker and was then emitted therefrom. He answered that he could clearly hear both a voice of an announcer and music.

REFERENCE SIGNS LIST

1, 11(A, B, C, D) diaphragm
1*a* one end
1*b* another end
2, 12 driver unit
3 housing
4, 14 clip
5 guide protrusion
6 edge support member
8 voice signal splitter
10, 20, 30, 40, 50, 60, 70, 80, 90 universal speaker
15 guide recess
16 vibration buffer member
17 (17A, 17B) fastener
18 wide guide recess
21 yoke
22 driver circuit
23 voice coil
24 pole piece
25 magnet (permanent magnet)
26 diaphragm driving portion
31 bottom plate
32 front plate
33 back plate
34 side plate
35 overhanging portion
36 fixation piece
39 opening
41, 42 mouth

The invention claimed is:

1. A universal speaker comprising:

only a single diaphragm in a flat plate shape;

a driver unit configured to vibrate the single diaphragm in accordance with an inputted electric signal; and a housing having a hollow structure to house the single diaphragm and the driver unit, wherein the housing has an opening on one side, the driver unit is brought into contact with an edge portion of the single diaphragm to be driven in the same direction as a direction of a plane of the single diaphragm and is fixedly attached to the housing, the single diaphragm is formed into only a single curved surface portion curved from one end side to which the driver unit is attached, toward another end side opposite to the one end side, and disposed to cover the opening of the housing, and two side edge portions of the single diaphragm are supported by curved guides in the housing.

2. The universal speaker according to claim 1, wherein the driver unit includes a moving magnet actuator.

3. The universal speaker according to claim 1, wherein the driver unit includes a moving coil actuator.

4. The universal speaker according to claim 1, wherein the two side edge portions of the diaphragm are partially supported by the housing.

5. The universal speaker according to claim 1, wherein the two side edge portions of the diaphragm are supported by the housing through vibration buffer members.

6. The universal speaker according to claim 1, wherein a plurality of the driver units are attached to the one end side of the diaphragm.

7. A universal speaker comprising:

a diaphraqm in a flat plate shape;

a driver unit configured to vibrate the diaphragm in accordance with an imputed electric signal; and a housing having a hollow structure to house the diaphragm and the driver unit, wherein the housing has an opening on one side, the driver unit is brought into contact with an edge portion of the diaphragm to be driven in the same direction as a direction of a plane of the diaphragm and fixedly attached to the housing, the diaphragm is formed into a curved surface portion curved from one end side to which the driver unit is attached toward another end side opposite to the one end side, and disposed to cover the opening of the housing, two side edge portions of the diaphragm are supported by curved guides in the housing, and the driver unit is additionally attached to the other end side of the diaphragm.

8. The universal speaker according to claim 7, wherein one of the driver units includes an actuator utilizing a piezoelectric body.

9. The universal speaker according to claim 7, further comprising:

means for splitting the electric signal into multiple frequency bands, wherein electric signals thus split are inputted to the different driver units, respectively.

10. The universal speaker according to claim 1, wherein a bending angle of the curved surface portion of the diaphragm is from 90° to 130°.

11. The universal speaker according to claim 1, wherein the diaphragm is part of the housing.

12. The universal speaker according to claim 1, wherein the edge portion of the diaphragm is attached in contact substantially at right angle to a diaphragm driving portion of the driver unit.

13. A universal speaker comprising:

a diaphragm in a flat plate shape;

a driver unit configured to vibrate the diaphragm, in accordance with, an inputted electric signal; and a housing having a hollow structure to house the diaphragm and the driver unit, wherein the housing has an opening on one side, the driver unit is brought into contact with an edge portion of the diaphragm to be driven in the same direction as a direction of a plane of the diaphragm and fixedly attached to the housing, the diaphragm is formed into a curved surface portion curved from one end side to which the driver unit is attached, toward another end side opposite to the one end side, and disposed to cover the opening of the housing, two side edge portions of the diaphragm are supported by curved guides in the housing, the edge portion of the diaphragm is attached in contact substantially at a right angle to a diaphragm driving portion of the driver unit, and the diaphragm is attached by using a clip fixed to an upper face of the diaphragm driving portion of the driver unit.

14. The universal speaker according to claim 13, wherein the clip adopts a clipping structure having spring elasticity.

15. The universal speaker according to claim 13, wherein the clip adopts a structure capable of adjusting a clipping clearance.

16. The universal speaker according to claim 1, wherein the two side edge portions of the diaphragm are supported by using curved guide protrusions provided in inner faces of right and left side plates of the housing, respectively.

17. The universal speaker according to claim 16, wherein edge support members to support the diaphragm partially by point contact are disposed on an upper face of each guide protrusion.

18. The universal speaker according to claim 1, wherein the two side edge portions of the diaphragm are supported by using curved slit-like guide recesses provided in inner faces of right and left side plates of the housing, respectively.

19. The universal speaker according to claim 18, wherein edge support members to support the diaphragm partially by point contact are disposed on an upper face and a lower face of each guide recess.

20. The universal speaker according to claim 1, wherein the single diaphragm extends from one end of the opening to an opposite end of the opening and is secured to the housing at opposite ends thereof to entirely cover the opening.

* * * * *